United States Patent [19]

Möhring et al.

[11] Patent Number: 4,584,588

[45] Date of Patent: Apr. 22, 1986

[54] ANTENNA WITH FEED HORN AND POLARIZATION FEED

[75] Inventors: Gunter Möhring, Langenhagen; Detlef Block, Hanover, both of Fed. Rep. of Germany

[73] Assignee: Kabelmetal Electro GmbH, Hanover, Fed. Rep. of Germany

[21] Appl. No.: 551,287

[22] Filed: Nov. 14, 1983

[30] Foreign Application Priority Data

Nov. 12, 1982 [DE] Fed. Rep. of Germany ..... 3241890

[51] Int. Cl.[4] ..... H01Q 13/02; H01Q 19/13

[52] U.S. Cl. ..... 343/786; 343/840

[58] Field of Search ..... 343/786, 756, 772, 779, 343/781 R, 782, 783; 333/21 R, 21 A

[56] References Cited

U.S. PATENT DOCUMENTS

| | | | |
|---|---|---|---|
| 2,682,610 | 6/1954 | King | 343/786 |
| 2,769,145 | 10/1956 | Zaleski et al. | 333/21 R |
| 2,816,271 | 12/1957 | Barker | 333/21 R |
| 2,897,457 | 7/1959 | Marié | 333/21 R |
| 3,369,197 | 2/1968 | Giger et al. | 343/786 |
| 3,715,688 | 2/1973 | Woodward | 333/21 A |
| 3,864,688 | 2/1975 | Hansen et al. | 343/840 |

*Primary Examiner*—Eli Lieberman
*Assistant Examiner*—Michael C. Wimer
*Attorney, Agent, or Firm*—Ralf H. Siegemund

[57] ABSTRACT

A polarization feed is provided for use in a directional antenna under separation of two linearly polarized electromagnetic waves whereby the feed is basically comprised of a tube, one end of which flares into a feed horn configuration and two wave guides are connected thereto, one ending laterally with its axial end at the feed tube while the other one has one side connected to the other axial end of the feed tube under consideration that respective long cross sectional dimensions are 90° rotated with respect to each other as connected to the tube. Appropriate means are provided for obtaining low reflection feeding.

8 Claims, 4 Drawing Figures

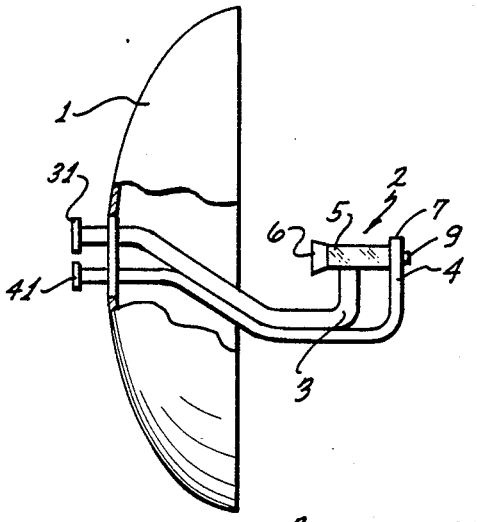
FIG. 1
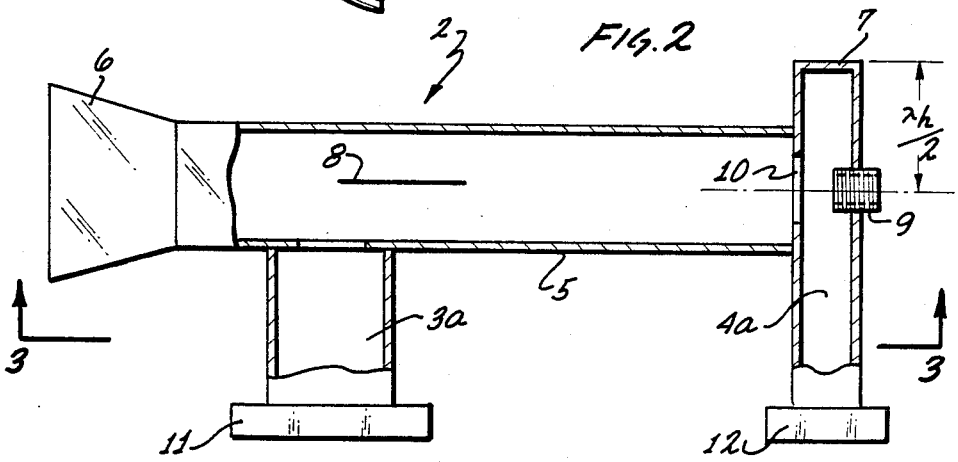
FIG. 2
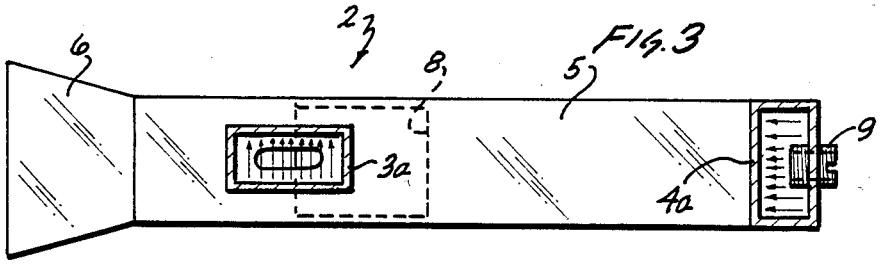
FIG. 3
FIG. 4
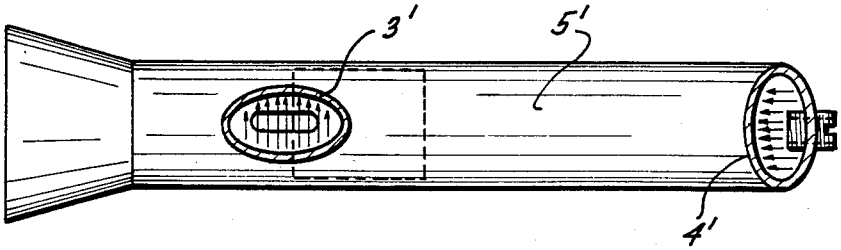

ANTENNA WITH FEED HORN AND POLARIZATION FEED

BACKGROUND OF THE INVENTION

The present invention relates to an antenna with feed horn and polarization feed for combining or separating two linearly polarized electromagnetic waves. The antenna is of the directional or focusing variety with parabolic reflector and includes a tubular member being provided with a feed horn facing the reflector with a widening opening; further included are two wave guides connected to the above mentioned tube and separately guiding the two electromagnetic waves while being provided with differently wide dimensions in the respective plane of polarization and the respective plane transversely thereto, the connection being such that these two wave guides are disposed one behind the other in a plane with reference to the reflector. Moreover, one of the wave guides is connected with its front end in radial direction to the tubular member such that the wide side of that particular wave guide extends in the direction of the axis of the tubular member; moreover a short circuiting element is provided in the interior of the tubular member between the connection to the first mentioned wave guide and the end of the tube facing away from the feed horn.

Directional antennas of the type to which the invention pertains serve the wireless transmission of electromagnetic waves from one location to another one. They are used, for example, for the radio linking systems; communication links with satellites; radio location and direction finding equipment and etc. They should be provided with a very high degree of efficiency, simply in order to obtain a large effective distance and range. Accordingly, directional antennas of the type to which the invention pertains are equipped with energizing means which insure a high attenuation of side lobes, particularly in parasitic directions, and also are provided with a high degree of matching and overall gain. The energizing device or the antenna is usually equipped with a feed horn being arranged in the focus of a parabolic antenna which, unfortunately, entails a shading effect provided by the feed line that leads to the feed horn. These feed lines are usually electromagnetic wave guide. Their physical presence constitutes a certain shading effect which in a detrimental fashion interferes with the radiating characteristics of the antenna. The aforementioned drawbacks will, in fact, be even more noticeable if the antenna is used for two, basically separate electromagnetic waves which are either concurrently broadcasted or received or wherein one is transmitted and the other one is received. These two different waves are differently polarized and it is therefore customary to provide a polarization feed ahead of the feed horn into which the two feed lines feed; these two lines run the respective waves separately to the antenna. This double feeding, of course, provides an additional shading for the antenna.

U.S. Pat. No. 3,864,688 describes basically a polarization feed of the type outlined above, and it proposes to keep the shading effect as small as possible by connecting the two wave guides to the tubular input of the feed horn in the same plane. Therefore, these two wave guides can be run in a single plane, one behind another. However, it was found that such a mode of connection is disadvantaged by the fact that separating the two electromagnetic waves requires a considerable effort as far as the construction of the tubular feed element for the feed horn is concerned, which has to be made with a high degree of precision because one wave has to be turned by 90° without interfering with the other wave and without incurring reflection. This particular objective is obtained in the equipment as per the U.S. patent by means of pins or a twisted sheet metal strip arranged in the tube between the two feed points, whereby the pins, if used, are azimuthally displaced.

DESCRIPTION OF THE INVENTION

It is an object of the present invention to provide a new and improved polarization feed for two electromagnetic waves for a feed horn of an antenna providing least possible shading and permiting simple connection to the feed lines such as wave guides without requiring supplemental features for separating the two waves.

It is a further object of the present invention to provide a new and improved antenna with a parabolic reflector and a feed horn arranged in the focal area of the reflector to be connected to a first and a second wave guide by means of a polarization feed.

In accordance with the preferred embodiment of the invention, a polarization feed is suggested to include a feed tube of which the feed horn is an extension of one end; the first wave guide is connected laterally to the feed tube such that a long dimension, either a long axis of an ellipses or the long side of a rectangle, extends parallel to the axis of the feed tube. A shortcircuiting element is disposed inside the feed tube essentially between the connection of this first wave guide and the other end of the feed tube; the second wave guide extends parallel to the first one in the area of connection and is laterally connected with a wide dimensional side to the other end of the feed tube closing the same. The connection, therefore, is such that the respective wide dimensions of the first and second wave guide at the connections are turned by 90°, and the wide dimension of the second wave guide, likewise being either the long side of a rectangle or the long axis of an ellipse, extends transversely to the axis of the feed tube. The second wave guide is shortcircuited at one end, preferably by means of a shortcircuiting element spaced from the axis of the feed tube by a distance equal to half the wave lengths with reference to the center of the transmission band to be transmitted. Moreover, the second wave guide is provided with an adjustable trimming means in axial alignment with the axis of the tube.

The connection to the feed tube for the feed horn is made in such a manner to permit the two wave guides to be run in the same plane and through the reflector such that the reflector is shaded very little. The polarization feed as such is constructed in an extremely simple manner because it is basically comprised of a simple tube of which the feed horn is just one extension. The polarization feeding effect is basically obtained through the particular connection of the two wave guides to that feed tube. The connection is such that the two planes or directions of polarization are turned by 90° with reference to the common tubes to which they are connected. In other words, the two waves are fed into the feed tube at right angles. This is the basic element for obtaining the polarizing effect. No additional parts are needed which would have to be precision made for obtaining the requisite coupling effect as its is customary in prior art devices.

As far as the second wave guide is concerned, it runs parallel to the first one at least in the area of feeding, but that parallelism can be maintained. The connection of the wave guide to the end of the feed tube facing away from the horn is a side-to-end connection so that no particular transition piece is necessary. Instead, a direct and low-reflection connection is made possible whereby particularly the reflection minimum is made adjustable through the trimmer arranged on the axis on the tube. A diaphragm is interposed between this particular wave guide and the end of the feed tube facilitates trimming further.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a somewhat schematic view of an antenna with polarization feed constructed in accordance with the preferred embodiment of the present invention for practicing the best mode thereof;

FIG. 2 illustrates in cross-sectional detail of the polarization feed included in the antenna of FIG. 1 but in an enlarged scale;

FIG. 3 is a view analogously to FIG. 2 but with a 90° change of the viewing plane; and FIG. 4 is a view similar to FIG. 3, but the wave guide combinations differ.

Proceeding now to a detailed description of the drawings, FIG. 1 illustrates a parabolically shaped reflector 1 of an antenna having a focal point in which is disposed the feed horn 6 being arranged at the end of a novel polarization feed 2. The construction of the polarization feed 2 is shown in greater detail in FIGS. 2, 3 and 4. Two wave guides 3 and 4 are connected to the polarization feed. These wave guides have their free ends affixed to the reflector 1 and are, in fact, run through the reflector. Additional wave guides can be connected to the ends 31 and 41 of these two wave guides which connections are to be made external to the reflector 1, i.e. on the side facing away from the direction of the beam emanating from or being received by the reflector.

The polarization feed, as can be seen from FIGS. 2 and 3, is basically comprised of a tubular member 5 which could have a square-shaped cross section or it could be round (FIG. 4). One end of the tube 5 is enlarged to establish the feed horn 6. The other end of the tube 5, in axial direction, is closed by the end of the wave guide 4. Thus, one can say that the tube 5 constitutes a continuation of the wave guide 4 but these two wave guides have differently wide dimensions in the direction of polarization on one hand and in the direction transverse thereto on the other hand. By way of example, the wave guide 4 may be rectangularly-shaped, or elliptically-shaped as is shown in FIG. 4, wave guide 4'.

The wave guide 3 is likewise rectangularly shaped, but it could be of elliptical construction (FIG. 4—wave guide 3'). The connection of the wave guide 3 to tube 5 is such that the wave guide 3 runs radially towards the tube 5 and ends with its front on a side wall of a wave guide 5, whereby the wider side of the rectangle extends in the direction of the axis of the tube 5. In the immediate vicinity of the tube 5, wave guide 4 runs parallel to the wave guide 3, therefore wave guide 5 has a direction of propagation which is radial with respect to the tube 5. However, as was stated above, the wave guide 4 does not end at the tube 5 with its front but with a wider lateral surface which therefor connects to the axial end of the tube 5, which end faces away from the feed horn 6.

It thus appears that the wave guide 4 is 90° rotated as far as its connection to the tube 5 is concerned with respect to the connection of the wave guide 3. Wave guide 4 terminates the end of the tube 5 facing away from the horn completely. Moreover, the true end of the wave guide 4 is shortcircuited, for example, by means of a shortcircuiting sheet 7. This shortcircuiting sheet 7 should have a distance from the center of tube 5 equal to one-half of the medium wave guide wave length with respect to the frequency band to be transmitted; $\lambda\eta/2$ designates this relation.

It can thus be seen that the two waves passing through the wave guide 3 and 4 are fed to and into the tube 5 through the illustrated arrangement such that they are 90° rotated as far as their respective direction of polarization is concerned. The same holds true with regard to elliptical wave guides 3' and 4'. The arrows in FIGS. 3 and 4 demonstrate this difference in direction of polarization. This spatial orientation of polarization as it is effective inside tube 5 is simply the result of the particular connection made and by the orientation of the wave guides involved as they are run to the feed pipe 5 (or 5'). Therefore, the two waves are already decoupled as they are fed into the tube 5 so that additional decoupling within the polarization feed 2 is no longer necessary.

The polarizing effect is a direct and immediate result of the connection and feeding. Any supplemental pieces of equipment connected to and being part of the polarization feed 2 are only of the usual type which insure coupling of the wave guides to the tube 5 per se in a manner which suppresses and avoids reflection and other interference.

In this regard there may be, for example, provided a shortcircuiting element 8 being disposed more or less between the feed point of the wave guide 3 and the end of the tube 5 to which the wave guide 4 is connected. The shortcircuiting may, for example, be a stationary sheet being appropriately secured in the tube 5. Instead of the sheet, one could use pins arranged in this axial direction. This way one insures that the wave fed into the tube 5 by the wave guide 3 will propagate only in the direction of the feed horn 6.

A trimming element 9 is disposed in that wall of wave guide 4 which faces away from the side that connects to the tube 5. Still, trimming element is arranged on a wide side of the rectangular wave guide 4 and is situated directly in the axis of tube 5. Preferably, trimmer 9 is adjustable in the direction of that axis. In the illustrated embodiment, trimmer 9 is constructed as a threaded pin by means of which a low reflection type feeding of the wave guide 4 into the tube 5 can readily be obtained by adjustment. After appropriate adjustment and trimming, element 9 is arrested in its position to prevent further adjustment, i.e. detuning.

In lieu of the single trimming element 9 as illustrated, one could provide two or more trimming elements, all within the extended axis of tube 5. Conceivably, one could provide trimming elements within the tube 5 which may be provided in addition in a manner known per se, and for this reason they have not been illustrated. Further matching as between the wave guide 4 and the tube 5 may include a diaphragm 10 such that particularly in a larger frequency range, a low reflection like tuning is more easily attainable through adjustment by way of the trimming elements as mentioned.

The polarization feed 2 can be made in that the two wave guides 3 and 4 are shown in FIG. 1 are connected directly to a single piece tube 5. This is shown in FIG. 1. On the other hand, one could provide the polarization feed as a single piece with short wave guide ends 3*a* and 4*a* as structurally combined elements as far as the tube 5 is concerned and their ends are provided with connecting flanges 11 and 12 to which are connected the wave guides proper. This approach has the advantage that actually the entire configuration shown in FIGS. 2, 3 and 4 can be made as integral pieces through galvanoplastics which permits an extremely accurate construction as far as the mutual orientation of the various elements is concerned; by and in itself this feature improves reflection-free feeding.

The two wave guides 3 and 4 should be, as is shown in FIG. 1, run basically within a single plane. This way one obtains minimum shading of the antenna and its reflector. This shading can, in fact, be reduced further by turning the wave guide 4 at its flange end by 90° so that the two wave guides are, in fact, superimposed with their narrow sides. This is not illustrated in FIG. 1 but the concept is readily derivable therefrom.

The polarization feed as illustrated was described with reference to the simultaneous transmission of two waves both of which are transmitted by the reflector 1. However, the construction is equally applicable for the simultaneous receiving of two waves having polarizations which are rotated by 90°. Also, one wave may have been received, the other one transmitted.

The construction is illustrated shows that the two wave guides are of rectangular cross-section and, as stated, the long dimension of wave guide 3 extends in the direction of the axis of the tube 5 while the long dimension of the rectangular of wave guide 4 extends transversely thereto. In this regard, it is practical to have the tube 5 of square shaped cross section but a circular cross section is possible. Also the principles of the inventions are equally applicable if the wave guides have elliptical contour (FIG. 4) so that the wide dimension of the respective rectangles are, in fact, replaced by the long axis of the respective ellipses. It should be noted, that elliptical wave guides can be used with either a square-shaped or a round feed tube; the same is true with regard to rectangular wave guides such as 3*a* or 3*b*.

The invention is not limited to the embodiments described above but all changes and modifications thereof not constituting departures from the spirit and scope of the invention are intended to be included.

We claim:

1. In an antenna for the transmission and/or receiving of electromagnetic waves and having a parabolic reflector and a feed horn arranged in the focal area of the reflector, there being a first and a second wave guide, the combination comprising:

a feed tube having an axis, the feed horn being arranged at one end of the tube;

the first wave guide being connected laterally to the feed tube whereby any long dimension of the cross section of the first wave guide extends parallel to the axis of the feed tube;

a short circuiting element disposed inside the feed tube essentially between the connection of the first wave guide to the feed tube and the other end of the feed tube;

the second wave guide having a wide and a narrow side and extending parallel to the first wave guide and being laterally connected with its wide side to the other end of the feed tube, closing the feed tube at that other end such that the wide dimensions of the first and second wave guides at their respective connections are turned by 90 degrees with respect to each other, the wider dimension of the second wave guide extending transversely to the axis of the feed tube accordingly;

means for shortcircuiting the second wave guide at its end; and trimming means disposed on the second wave guide in axial alignment with the axis of the tube.

2. The combination as in claim 1, said trimming means being adjustable in a relation to and along said axis.

3. The combination as in claim 1, there being a diaphragm interposed between the feed tube and the first and second wave guide.

4. The combination as in claim 1 wherein said means for short circuiting the second wave guide are spaced from the axis of the feed tube by a distance equal to half the center wave guide wave length as referred to the frequency band to be transmitted.

5. The combination as in claim 1 wherein the two wave guides have rectangular cross section.

6. The combination as in claim 1 wherein said wave guides have elliptical cross section.

7. The combination as in claim 1 wherein said feed tube has circular cross section.

8. The combination as in claim 1 wherein said feed tube has square-shaped cross section.

* * * * *